US006698400B2

(12) United States Patent
Kurtenbach et al.

(10) Patent No.: US 6,698,400 B2
(45) Date of Patent: Mar. 2, 2004

(54) PISTON INTERNAL COMBUSTION ENGINE COMPRISING A DEFLECTION-RESISTANT CROSS BRACE FOR SEALINGLY FIXING FUEL INJECTION

(75) Inventors: Rainer Kurtenbach, Aachen (DE); Jakob Nehl, Aachen (DE); Hans-Dieter Sonntag, Würselen (DE); Volker Theisen, Düren (DE)

(73) Assignees: FEV Motorentechnik GmbH, Aachen (DE); Isuzu Motors Limited, Tokyo (JP)

( * ) Notice: Subject to any disclaimer, the term of this patent is extended or adjusted under 35 U.S.C. 154(b) by 0 days.

(21) Appl. No.: 10/069,777

(22) PCT Filed: May 16, 2001

(86) PCT No.: PCT/EP01/05538

§ 371 (c)(1),
(2), (4) Date: May 21, 2002

(87) PCT Pub. No.: WO02/02927

PCT Pub. Date: Jan. 10, 2002

(65) Prior Publication Data

US 2002/0152994 A1 Oct. 24, 2002

(30) Foreign Application Priority Data

Jun. 30, 2000 (DE) ..... 100 32 003

(51) Int. Cl.[7] ..... F02M 37/04
(52) U.S. Cl. ..... 123/470; 123/90.27
(58) Field of Search ..... 123/470, 90.27

(56) References Cited

U.S. PATENT DOCUMENTS 4,901,700 A * 2/1990 Knight et al. ..... 123/470
6,116,218 A * 9/2000 Sato et al. ..... 123/470
6,170,467 B1 * 1/2001 Girard ..... 123/470
6,269,798 B1 * 8/2001 Takahashi et al. ..... 123/470

FOREIGN PATENT DOCUMENTS

| | | |
|---|---|---|
| DE | 26 49 357 A | 3/1978 |
| DE | 39 43 728 A | 2/1994 |
| DE | 196 05 934 C | 6/1997 |
| EP | 0 751 290 A | 1/1997 |
| EP | 0 848 158 A | 6/1998 |

* cited by examiner

*Primary Examiner*—Thomas N. Moulis
(74) *Attorney, Agent, or Firm*—Venable LLP; Robert Kinberg

(57) ABSTRACT

The invention relates to a piston internal combustion engine comprising upper camshafts (2, 3) for actuating gas exchange valves, whereby respectively adjacent lying bearings of the induction-side camshaft (2) and the exhaust-side camshaft (3) are provided with a covering element (5) scaling both bearings. The inventive engine is also provided with direct fuel injection by means of a respective injector device (7) which has a nozzle part and which is associated with a cylinder (I, II, III, IV). The nozzle part is sealingly inserted into an opening in the cylinder head (1) and a cross brace (8) is fixed to the cylinder head (1) in a deflection-resistant manner, overlapping with at least one injector device (7). The cross brace is connected to tightening elements (11) enabling the injector devices (7) to be sealingly tightened in relation to the cross brace (8). The cross brace (8) is connected to least two neighbouring bearing-covering elements (5).

5 Claims, 2 Drawing Sheets

PISTON INTERNAL COMBUSTION ENGINE COMPRISING A DEFLECTION-RESISTANT CROSS BRACE FOR SEALINGLY FIXING FUEL INJECTION

BACKGROUND OF THE INVENTION

With piston-type internal combustion engines with direct fuel injection, the injection devices are inserted so as to be sealed with the nozzle into an opening in the cylinder head and are secured on the cylinder head with fastening means that can be tightened. German Patent A-26 49 157 discloses providing each injection device with a separate crossbar for securing the injection device with two tightening screws on the cylinder head, directly adjacent to the insertion opening.

The same published reference discloses providing a supporting extension on the cylinder head, on which the free end of a clamping means is supported, while the other, fork-shaped end rests on the injection device. The injection device is subsequently tightened against the cylinder head, so as to be sealed, by means of a tightening screw positioned between the supporting extension and the injection device. A separate fastening of this type is very expensive to produce and requires an involved assembly.

A modification of the above-described type of fastening is known from European Patent A-0 751 290. With this design, the injection device is embodied at the upper end in the form of a T, wherein the one lateral arm accommodates the fuel supply and the other lateral arm the electrical valve actuation. With a piston-type internal combustion engine with serial arrangement of the cylinders, several of the side-by-side positioned injection devices are secured by means of a bridge-shaped tightening element, extending in longitudinal direction of the engine. This tightening element is respectively attached to the cylinder head with a tightening screw, arranged between two neighboring injection devices. For the fastening of the injection device, the bridge-shaped tightening element is in this case also attached with a separate screw connection to the cylinder head. Owing to the elastic tightening with the bridge-shaped fastening element, this known design also has the disadvantage that vibrations originating from the injectors result in a sound emission from the top of the engine. Furthermore, the fastening screws must absorb high forces because of the high injection pressures, so that the associated regions with the thread holes on the cylinder head must have a correspondingly solid design.

SUMMARY OF THE INVENTION

It is the object of the invention to create a fastening for the injection devices of a piston-type internal combustion engine of the aforementioned type, which fastening avoids the above-described disadvantages.

This object is solved with a piston-type internal combustion engine, provided with overhead camshafts for actuating the cylinder valves, wherein respectively side-by-side arranged bearings for the intake-side camshaft and the discharge-side camshaft comprise a bearing cover element that closes off both bearings. The engine is further provided with direct fuel injection, comprising respectively one injection device with nozzle unit that is assigned to one cylinder and is inserted so as to be sealed into an opening in the cylinder head. The engine is also provided with a crossbar attached rigidly to the cylinder head and spanning at least one injection device. The crossbar is connected to tightening means, which serve to tighten the injection devices such that they are sealed relative to the crossbar, wherein the crossbar is connected to at least two neighboring bearing cover elements. The solution according to the invention has the advantage that the already existing fastening means for the bearing cover elements are also used to fasten the crossbar for tightening the injection device. The crossbar is essentially designed to be non-flexible so that the total arrangement can have a very rigid design in connection with the possible tightening with the fastening means for the bearing cover elements. Thus, the excitation of vibrations via the camshafts as well as the injection devices is practically avoided and the emission of sound is clearly reduced in this region. In addition, this results in a better transfer of the holding forces, necessary for tightening the injection device, onto the cylinder head as well as an improvement in the fatigue strength by also making use of the already more solid regions for fastening the camshafts.

According to another particularly advantageous embodiment of the invention, a longitudinal support is provided that serves as crossbar and spans several injection devices and is attached to the cylinder head with respectively two fastening means for the bearing cover elements, which are adjacent to an injection device.

Another embodiment of the invention provides that the crossbar extends crosswise to the camshaft orientation and is secured respectively via the fastening screws for the bearing cover elements. It is possible in this way to securely tighten respectively one injection device with one crossbar between two neighboring bearing cover elements, wherein the crossbar can be connected to the bearing cover elements, such that it is detachable.

It is particularly advantageous, however, if the crossbar is connected as one piece, material on material, with the bearing cover elements, thereby resulting in a structural unit for holding the camshaft bearings as well as the injection devices on the cylinder head. This structural component can be optimized with respect to its strength as well as its non-flexibility by providing it with a corresponding profiling, taking into account the fatigue strength requirement. Special fastening means for the injection devices can be omitted in that case. By using this design, the vibration willingness of the complete component can be reduced further, so that the excitations caused by the changing camshaft forces and the pressure pulsation of the injection devices do not result in a sound emission.

Another embodiment of the invention furthermore provides that the bearing cover elements are connected to form one piece, material on material, with at least one additional longitudinal bar. The use of a continuous longitudinal bar—it is preferable if two parallel-arranged longitudinal bars are used—results in a very compact, grid-type rigid structural component for securing the camshaft bearings and the injection devices. This component not only facilitates the assembly of the camshaft bearings and the injection devices, but also virtually prevents the transfer of structure-born sound to the outside.

The invention is described in further detail with the aid of schematic drawings of exemplary embodiments.

DETAILED DESCRIPTION OF THE INVENTION

Figure 1:
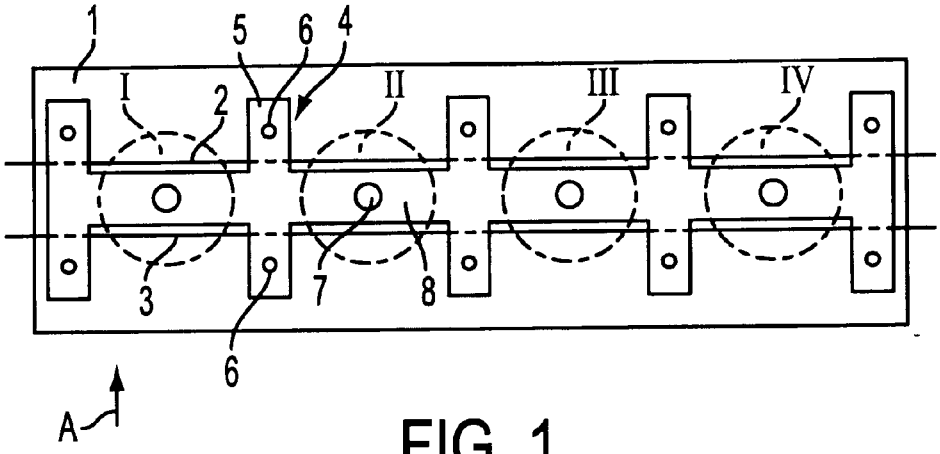
FIG. 1 is a view from above of a 4-cylinder piston-type internal combustion engine with a first embodiment of a crossbar for fastening the injection devices.

FIG. 1 shows a view from above of the cylinder head 1 of a 4-cylinder piston-type internal combustion engine. The cylinder valves for the individual cylinders I, II, III and IV, which are not shown in further detail herein, are respectively actuated on the gas intake side and the gas discharge side via an overhead camshaft 2 and 3. The camshafts are positioned on the cylinder head 1 with the aid of camshaft bearings 4 that are respectively positioned on the ends and respectively between two adjacent cylinders. The camshaft bearings 4 are respectively closed off at the top by bearing cover elements 5 that extend across both camshaft bearings 4. The bearing cover elements 5 are screwed tightly onto the cylinder head 1 with fastening screws 6.

The individual cylinders I, II, III and IV are each assigned one injection device 7 with a standard design, which is inserted into an opening in the cylinder head, so that its nozzle unit projects into the inside space of the associated cylinder.

A crossbar 8 is provided to tighten the injection devices 7, such that they are sealed, which crossbar respectively spans the injection devices 7. For the embodiment shown herein, this crossbar is designed as longitudinal support that spans several injection devices 7 and is connected as one piece, material on material, with the bearing cover elements 5. All injection devices 7 are covered by the continuous longitudinal support, which respectively functions as crossbar 8 between two bearing cover elements 5, and are tightened against the cylinder head 1 with fastening screws 6 of bearing cover elements 5.

Depending on the structural conditions, it is also possible to divide the arrangement, so that a structural component consisting of bearing cover elements 5 and crossbar 8 is respectively provided for a single cylinder or several adjacent cylinders.

Figure 2:
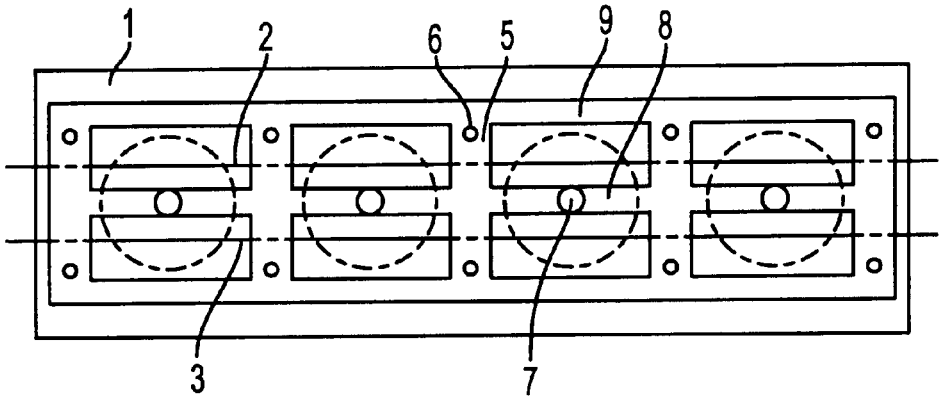
FIG. 2 shows a modified version of the design according to FIG. 1.

FIG. 2 shows a modified version of the embodiment according to FIG. 1. The bearing cover elements 5 of this embodiment are respectively connected as one piece with the outer ends to a continuous longitudinal bar 9, material on material, thereby resulting in an approximately grid-shaped, rigid component, which can be used to secure the camshafts and the injection devices on the cylinder head.

Figure 3:
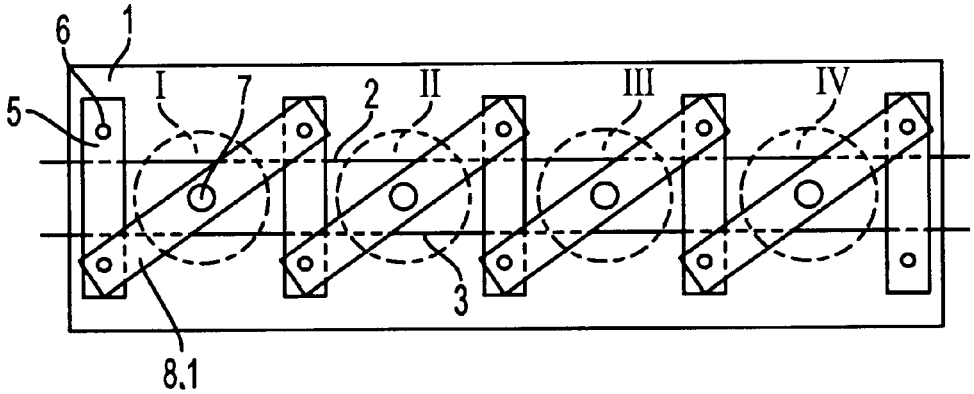
FIG. 3 shows a design using individual crossbars for securing the injection devices.

FIG. 3 shows another modified version of the embodiment, for which the bearing cover elements 5 are designed in the standard manner as individual elements and are secured on the cylinder head 1. The individual injection devices 7 for the cylinders are secured by means of individual crossbars 8.1 and the fastening screws 6 of bearing cover elements 5. The individual crossbars 8.1 in this case are arranged crosswise and at an angle to the alignment of camshafts 2, 3. The crossbars 8.1 in this case also have a rigid design owing to a special profiling, thereby resulting in the advantage that the individual crossbar 8.1 is respectively secured on the cylinder head 1 with the already existing fastening means for bearing cover elements 5. This embodiment can also be designed such that the crossbars 8.1 are connected material on material with the bearing cover elements 5, thus making available a structural component according to FIG. 1 or 2.

Figure 4:
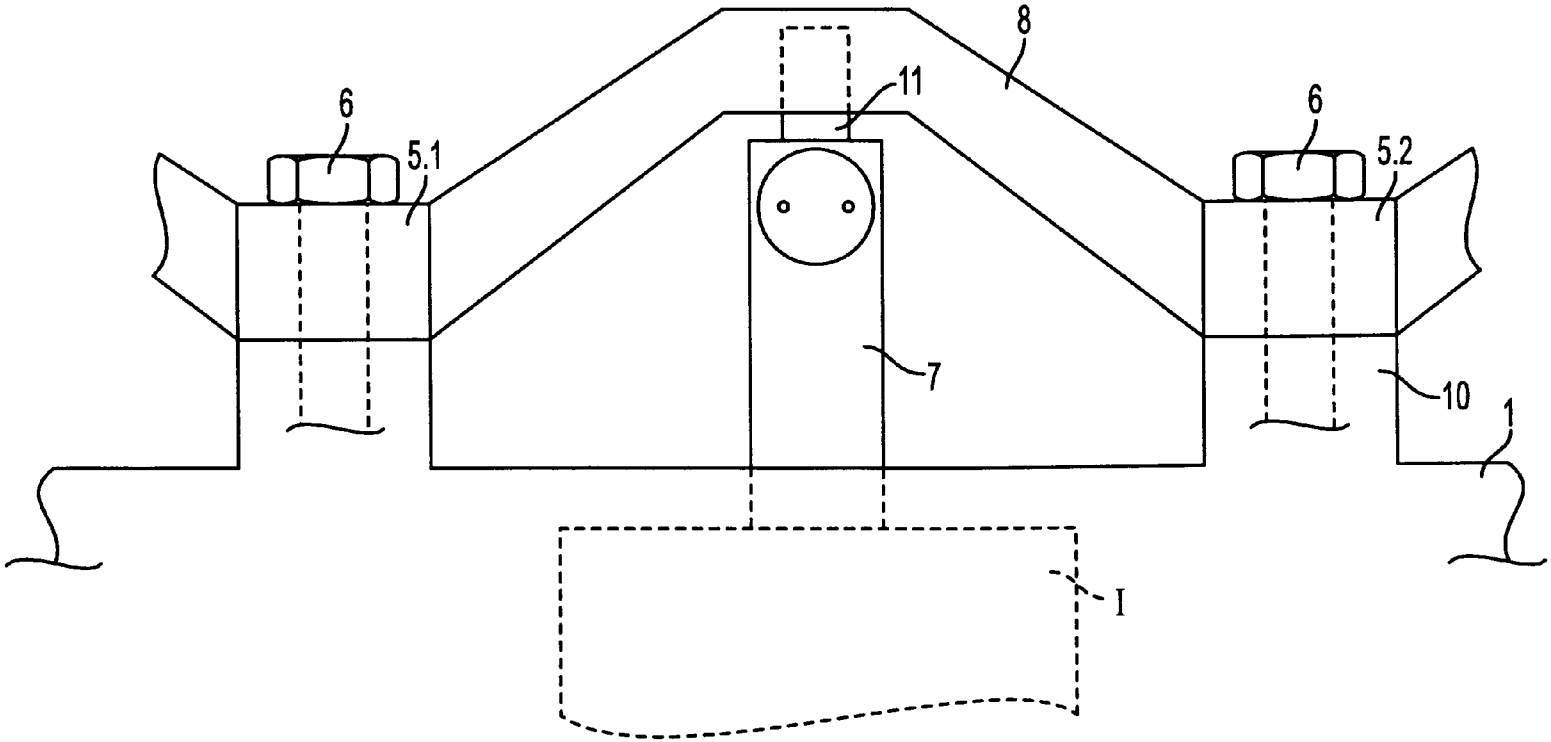
FIG. 4 shows an enlarged, partial view from the side, according to arrow A in FIG. 1.

The arrangement of such a structural component is shown as enlarged partial view from the side in FIG. 4, as seen in the direction of arrow A in FIG. 1.

Bearing brackets 10 are arranged on the cylinder head 1, for example in the region of cylinder I, in order to accommodate the crankshaft bearings, which are respectively closed off at the top with bearing cover elements 5. As shown in FIG. 1, the bearing cover elements 5 are connected by means of a continuous longitudinal support forming a crossbar 8 between respectively two bearing cover elements 5.1 and 5.2, which crossbar spans the associated injection device 7. Tightening means 11 are provided between the crossbar 8 and the injection device which, after being secured, permit a purposeful tightening of the injection device 7, respectively with the required contact pressure.

The simplest embodiment of these tightening means 11 can be a set of spring washers or the like, which is fitted onto the injection device 7. During the screwing together of the bearing cover elements, these tightening means simultaneously effect the necessary tightening that creates a seal between injection device 7, crossbar 8, and cylinder head 1.

However, it is also possible to use tightening means that may be combined with springs, if necessary, and are essentially designed as screw/nut combinations that permit a separate tightening of the individual injection devices following the mounting of the longitudinal support. Furthermore, it makes sense to provide a safety against over-tightening of the injection devices, either through respective structural measures in the transition region between cylinder head and injection device or by assigning such measures to the combination crossbar and injection device.

What is claimed is:

1. A piston-type internal combustion engine, provided with overhead camshafts (2, 3) for actuating the cylinder valves, wherein respectively side-by-side arranged bearings of the intake-side camshaft (2) and the discharge-side camshaft (3) have a bearing cover element (5) that closes off both bearings, further provided with direct fuel injection through a respective injection device (7) assigned to each cylinder (I, II, III, IV) and provided with a nozzle unit, which is inserted so as to be sealed into an opening in the cylinder head (1), further provided with a crossbar (8) that is rigidly fastened to the cylinder head (1) and spans at least one injection device (7), which crossbar is connected to tightening means (11) for a sealed tightening of the injection devices (7) relative to the crossbar (8), and wherein the crossbar (8) is connected to at least two neighboring bearing cover elements (5).

2. A piston-type internal combustion engine according to claim 1, characterized in that a longitudinal support is provided that serves as a crossbar (8) and spans several injection devices (7), which support is fastened to the cylinder head (1) with respectively two fastening screws (6) of the bearing cover elements (5), which are located adjacent to an injection device (7).

3. A piston-type internal combustion engine according to claim 1, characterized in that the crossbar (8) extends crosswise to the orientation of the camshafts (2, 3) and is respectively secured with the fastening screws (6) of the bearing cover elements (5).

4. A piston-type internal combustion engine according to claim 1, characterized in that the crossbar (8) is connected as one piece, material on material, with the bearing cover elements (5).

5. A piston-type internal combustion engine according to claim 1, characterized in that the bearing cover elements (5) are connected as one piece, material on material with at least one additional longitudinal bar (9).

* * * * *